US009261329B2

(12) United States Patent
Kempas

(10) Patent No.: US 9,261,329 B2
(45) Date of Patent: Feb. 16, 2016

(54) MISSILE CONTAINER AND METHOD OF OPERATING A MISSILE CONTAINER

(71) Applicant: DIEHL BGT DEFENCE GMBH & CO. KG, Ueberlingen (DE)

(72) Inventor: Hagen Kempas, Ueberlingen (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 14/138,337

(22) Filed: Dec. 23, 2013

(65) Prior Publication Data

US 2014/0224104 A1 Aug. 14, 2014

(30) Foreign Application Priority Data

Dec. 22, 2012 (DE) ..... 10 2012 025 316

(51) Int. Cl.
*F41F 3/04* (2006.01)
*F41F 3/042* (2006.01)
*F41A 23/20* (2006.01)

(52) U.S. Cl.
CPC ..... *F41F 3/042* (2013.01); *F41A 23/20* (2013.01)

(58) Field of Classification Search
CPC ..... F41F 1/00; F41F 3/042; F41F 3/073; F41F 3/04; F41F 3/052; F41A 23/20
USPC ..... 89/1.8, 1.801, 1.802, 1.803, 1.804
See application file for complete search history.

(56) References Cited

U.S. PATENT DOCUMENTS

| | | | | |
|---|---|---|---|---|
| 641,872 | A * | 1/1900 | Krone | 89/39 |
| 769,636 | A * | 9/1904 | Rausenberger | 89/39 |
| 1,200,215 | A * | 10/1916 | Mixsell et al. | 89/38 |
| 2,568,455 | A * | 9/1951 | Lindvall et al. | 89/1.819 |
| 3,217,900 | A * | 11/1965 | Kupetzky et al. | 414/742 |
| 3,800,659 | A * | 4/1974 | Kuiper | 89/40.03 |
| 4,573,396 | A * | 3/1986 | Streetman et al. | 89/36.08 |
| 6,584,881 | B1 * | 7/2003 | Boudreau et al. | 89/1.804 |
| 7,854,189 | B1 * | 12/2010 | Fox | 89/1.804 |
| 8,256,339 | B1 * | 9/2012 | Hamalian et al. | 89/1.815 |
| 8,393,258 | B2 * | 3/2013 | Cazalieres et al. | 89/41.01 |
| 8,468,924 | B2 * | 6/2013 | Skurdal et al. | 89/1.819 |
| 2006/0266208 | A1 * | 11/2006 | Jean-Francois et al. | 89/37.13 |
| 2008/0047421 | A1 * | 2/2008 | Carroll et al. | 89/38 |
| 2010/0095831 | A1 * | 4/2010 | Dekel | 89/1.815 |
| 2010/0282150 | A1 * | 11/2010 | Onuk | 114/15 |
| 2012/0152092 | A1 * | 6/2012 | Skurdal et al. | 89/1.819 |
| 2014/0116234 | A1 * | 5/2014 | Jacq | 89/1.11 |

* cited by examiner

*Primary Examiner* — Joshua Freeman
(74) *Attorney, Agent, or Firm* — Laurence A. Greenberg; Werner H. Stemer; Ralph E. Locher

(57) ABSTRACT

A missile container has a container housing, one or a plurality of canisters stored therein for supporting a missile, and a movement mechanism for moving the canister from a storage position into an operating position. The missile container is efficiently transferred from a storage state into a combat state, in which the canister is in a combat-ready position for firing the missile, by providing a movement mechanism with a kinematic linkage for pivoting the canister.

14 Claims, 15 Drawing Sheets

MISSILE CONTAINER AND METHOD OF OPERATING A MISSILE CONTAINER

CROSS-REFERENCE TO RELATED APPLICATION

This application claims the priority, under 35 U.S.C. §119, of German patent application DE 10 2012 025 316.8, filed Dec. 22, 2012; the prior application is herewith incorporated by reference in its entirety.

BACKGROUND OF THE INVENTION

Field of the Invention

The invention relates to a missile container having container housing, at least one canister mounted therein for supporting a missile, and a movement mechanism for moving the canister from a storage position into an operating position.

So-called surface-to-air missiles (SAM) or ground-to-air missiles (GTAM) are used in general for defense purposes. The missiles are stored in a canister and they are fired from the canister, either vertically or at an incline upwardly. When launching a missile from its canister, a hot jet of waste gas is produced, in the vicinity of which no sensitive components must be located if the destruction of those components is to be avoided. In order to protect the missile container and the inner components thereof against such damage, it is known to lift the canister from the container housing, for example to install it on a carriage of a vehicle and to fire it from there. The hot jet of waste gas is directed freely downwardly and to the side if the missile is shot at an incline, and does not impact on any sensitive components. In order to achieve this, it is necessary however to lift out the canister with its missiles from the container housing and to install it on an appropriate launching device.

Missiles are generally stored over relatively long periods of time and for this purpose are stored in the container housing of the missile container. Even during transport, they are arranged within the container housing of the missile container and are held therein in a firmly closed manner. So as to be able to be made ready for combat, the missiles have to be removed together with their canister from the container housing and appropriately positioned such that they can be launched without causing damage as a result of their jet of waste gas.

SUMMARY OF THE INVENTION

It is accordingly an object of the invention to provide a missile container assembly which overcome the above-mentioned disadvantages of the heretofore-known devices and methods of this general type and which provides for a missile container that can be efficiently brought into a combat state, in which the canister is in a combat-ready firing position of the missile.

With the foregoing and other objects in view there is provided, in accordance with the invention, a missile container, comprising:

a container housing;

at least one canister disposed in said container housing and configured for supporting a missile; and a movement mechanism having a kinematic linkage configured for pivoting and moving said at least one canister from a storage position in said container housing into an operating position.

This object is achieved by a missile container of the type mentioned in the introduction, with which, in accordance with the invention, the movement mechanism, or movement means, has a kinematic linkage for pivoting the canister.

In other words, the invention is based on the consideration that the production of a combat-ready state is accelerated if the canister for supporting the missile is not first lifted out from the container housing and installed on a launching device, where it then has to be moved into a combat-ready position. The combat-ready state can be produced much more quickly if the two movement processes of the at least partial lifting out of the canister from the container housing and the bringing into a firing position can be produced by a single movement mechanism. In order to implement this movement, the movement mechanism should enable a movement of the canister with a higher degree of freedom compared to a single rotation about an individual axis of rotation. This is possible by means of the kinematic linkage according to the invention. The canister, by the movement mechanism, can be both raised from its storage position and lifted out at least in part from the container housing, and also brought into a firing position in which the hot jet of waste gas of the driving mechanism does not generate any undesired damage.

The missile is expediently a rocket missile, that is to say a missile with a rocket driving mechanism, in particular a ground-to-air missile, a ground-to ground missile or a sea-based missile. The missile is an unmanned missile and expediently equipped with a warhead, which may house a detonation charge. The invention is not limited to missiles and a container for a missile. Instead of a missile, another object can be moved.

The canister is used to support the missile and additionally expediently to store the missile in the closed missile container and advantageously also to hold it in the event of firing. The missile is thus expediently fired from the canister and the canister is in this respect prepared for such a firing procedure. The storage position is a position of the canister in which the missile or the canister is stored over a storage period, for example over a number of months, in particular over a number of years.

The storage position is a position in which the missile or the canister with the missile is stored over a relatively long period of time. It may also be a transport position, in which the canister and the missile are transported on, or in, a vehicle. The operating position is a position in which the canister is in operation. Such an operation may be a firing of the missile canister, maintenance operation, in which the canister is serviced or repaired, test operation, for example for testing sensors of the canister or of the missile, or another suitable operation of the canister. The operating position is a position different from the storage position, wherein the canister in the operating position is expediently pivoted relative to the storage position.

The container housing is expediently a housing closed around the missile. It expediently has the dimensions of a 20-foot ISO transport container. The missile container can thus be combined and used with typical logistical systems for containers. It is further advantageous if the container housing can be closed in a splash proof manner such that the interior of the container housing is protected against highly damaging weather influences, such as rain or storm. With an embodiment of the container housing extremely similar to a standard transport container, such a weatherproofing can be achieved. In addition, simple and inconspicuous transport is possible. The container housing is expediently equipped with solid side walls and an access door. In addition, a control panel region with a protective covering, for example a protective flap, and in particular a connection for supply lines is additionally provided.

During storage and transport, the missile container or the container housing thereof is expediently closed, as described above. It may also be however that the missile container is located over a relatively long period of time in an alert state or in a state ready for activation, in which the canister is arranged in combat position. In order to protect the interior of the container housing in this state too against external influences over a relatively long period of time, it is advantageous if the container housing is closed even in the combat-ready state of the missile container or in the combat position of the canister. Similarly to the storage or transport state, it is advantageous if the container housing is splashproof in this case also, in particular from all sides.

A plurality of canisters for each supporting at least one missile are expediently arranged on the movement mechanism. Four or eight canisters per canister unit are conventional and are fastened to the movement mechanism as a unit, for example are themselves joined together firmly.

The movement mechanism is used to move the canister from the storage position into the operating position and to this end comprises a linkage. Alternatively, any other suitable movement element may also be provided. The movement mechanism is expediently designed to carry out a movement that has more degrees of freedom than a single rotation about a single axis of rotation. In this case, a higher degree of freedom is not necessarily to be understood to mean a higher dimensionality of the movement, since a one-dimensional movement is sufficient. Rather, a more complex movement path compared to a straight line or single circular or ellipsis path is to be enabled, for example a combination of two circular paths having different midpoints. More complex movement paths of this type will be referred to hereinafter as curve-line paths. A preferred possibility for producing such a curve-line path is a linkage. A linkage is not the only advantageous possibility however, and in this regard the invention, considered generally, is not limited to a linkage. For example, other transmissions that have one or more of the elements described below may also be provided.

A linkage is a transmission that converts a rotational movement into a non-rotational movement, for example into a movement in a straight line or an oscillating movement. The conversion of a movement in a straight line into an oscillating or rotational movement is also possible.

The linkage is advantageously formed with a multi-member, in particular four-member, kinematic chain. A multi-member kinematic chain has a number of kinematic members, whereas a four-member kinematic chain has four kinematic members. One of the members is a housing-fixed member and a further member is an operating member, also referred to as a coupling member, which performs the movement desired for the operation. With a four-member kinematic chain two further movable members, which are connected movably, generally pivotably, to the operating member and/or housing member, are provided between the housing member and the operating member. All four members are interconnected such that the movement of one of the movable members produces a forced movement of the other movable members.

Two movable members are expediently each connected to the housing member by means of a rotary joint having a fixed axis of rotation. It is likewise advantageous if two movable members are connected to the operating member in each case by means of a rotary joint, in particular having an axis of rotation that is not stationary, but is immobile in terms of its alignment, that is to say is only displaceable in parallel. It is particularly expedient if the operating member is connected via two movable elements of the linkage to the housing member. This can be implemented by a four-member kinematic chain. The two movable members are each connected via a rotary joint having a fixed axis of rotation to the housing element and on their other side are each connected via a rotary joint to the operating element. The operating element advantageously has a single degree of freedom, that is to say can only pass through a one-dimensional path. The operating member or coupling member is expediently a holding unit for holding the canister.

In accordance with an advantageous embodiment of the invention, the movement mechanism has a leverage having four housing-fixed rotation points. The leverage is used to move the canister. The four housing-fixed rotation points are expediently arranged symmetrically to one another in pairs. In this case, two housing-fixed rotation points are advantageously arranged opposite one another in each case, expediently in the two side walls of the container housing. They may thus form two fixed axes, which are thus arranged immovably relative to the container housing. These two fixed axes are expediently arranged parallel to one another and in particular are aligned horizontally, wherein the horizontal direction may be based on the direction of a base plate of the container housing, said base plate being aligned horizontally during regular operation of the missile container, that is to say parallel to a virtual water surface level on the earth's surface. The housing-fixed rotation points are advantageously arranged in, or on, the housing wall of the container housing, such that the two side walls of the expediently cuboidal container housing are used for the mounting of the rotation points or of bearing means for mounting of the rotation points.

The four housing-fixed rotation points are advantageously arranged to the side of the canister, such that the canister, as it moves from the storage position into the operating position, is moved through between the four rotation points, passing through the two fixed axes.

In a further advantageous embodiment of the invention, the movement mechanism comprises a holding unit, to which the canister is fastened and which is entrained with the canister from the storage position into the operating position, wherein the holding unit and the canister are expediently arranged immovably relative to one another during this movement. This holding unit can be moved by the multi member kinematic chain, in particular about the two fixed axes. The movement of the holding unit may be a rotation about the two fixed axes, wherein part of the holding unit is rotated about one fixed axis and another part of the holding unit is rotated about the other fixed axis. In this regard, one part moves in a circular path about one fixed axis and the other moves in another circular path about the other fixed axis, wherein the fixed axes do not coincide. A curve-line path of the canister is produced as a result of this movement combination.

Generally speaking, the movement mechanism in accordance with an advantageous development of the invention comprises two housing-fixed fixed axes, wherein the movement mechanism is designed to pivot the canister from the storage position into the operating position about these two fixed axes. A curve-line movement path of the canister that enables an advantageous operating position can be achieved in a simple way.

It is further advantageous if the movement mechanism has a holding unit provided with two pivot axes for holding the canister, each of the two pivot axes being connected via a coupling member to a fixed axis in a manner fixed against removal. The pivot axes thus each rotate in a circular path about their fixed axis, wherein each pivot axis is expediently assigned only a single fixed axis. The coupling member is in each case expediently a rod or another fixed element that has bearings for one of the pivot axes and one of the fixed axes.

The two fixed axes are advantageously arranged relative to one another in a horizontal region. The horizontal region comprises an angular range of ±30° to the horizontal, in particular at most ±20°, such that a plane through the two fixed axes thus has an inclination of less than 30° or 20° to the horizontal.

The pivot axes are movable in space, that is to say movable relative to the housing container, wherein it is advantageous if the two pivot axes, also in the storage position of the canister, are arranged in the horizontal region. A tilting of the canister as it is moved from the storage position can thus be counteracted.

If a canister or the holding unit is set down in a pivoting manner in the storage position, corresponding holding means can be slightly tilted. In this regard, a movement in translation of the canister and/or of the holding unit into the storage position is advantageous. A movement substantially in translation into the storage position can be achieved if the two axis pairs each formed of a fixed axis and a pivot axis are arranged, in the storage position, relative to one another in the horizontal region. In this case, the horizontal region extends over at most ±20°, in particular at most ±15°, to the horizontal. The movement in translation can be achieved particularly well if the horizontal region is arranged only in the range of ±10° to the horizontal, a plane through the corresponding axis pair thus being aligned in the horizontal with a deviation of at most ±10°.

The movement mechanism is equally advantageously expediently designed for the movement in translation of the canister from the storage position. A subsequent pivoting of the canister is advantageous in order to reach an advantageous operating position. The movement in translation expediently occurs over at least 10 cm, in particular at least 20 cm, upwardly. In this case, the movement in translation is not to be considered mathematically, but can be composed of one or more rotational movements, wherein it is sensible, in the event of the movement in translation, for a rotation of the canister to be no more than 3°, in particular less than 2°.

It is further proposed for the movement mechanism to be designed expediently to vertically lift the canister from the storage position and then pivot the canister. The vertical lifting is expediently a lifting in translation of the canister or of the holding unit to which the canister is fastened.

The canister or the holding unit is expediently moved by the force transmission of one or more movement motors into the linkage. In this case, a movement motor expediently acts on an element of the linkage and rotates it about a fixed axis. This movement can be implemented particularly forcefully and exactly by a linear movement motor, in particular with a hydraulic bar linkage. Generally speaking, an extension and/or shortening of a linear motor element is/are advantageous. The movement motor is expediently designed here such that the movement from the storage position into the operating position is implemented due to the continuous input of force into the movement mechanism by the movement motor. The force transmission of a movement motor can be implemented at a lever, which is pivoted about one of the fixed axes.

The pivoting of the lever can generate a lifting in translation and in particular vertically of the canister and a subsequent pivoting of the canister. A movement motor thus generates both the vertical lifting and in particular the lifting in translation as well as the subsequent pivoting by the introduction of forces from the same fixed points into the same moved bearings.

The movement mechanism advantageously comprises at least two movement motors, which are arranged on either side of a movement path of the canister or of the holding unit. A symmetrical force transmission into the system can thus be implemented.

A forceful and simple drive of the movement mechanism can be achieved if the movement motor has two motor units that are coupled in terms of their movement and that are arranged, in particular cooperating in pairs, on either side of the canister or of the holding unit. The motor units are formed in particular as a straight thrust bar linkage, for example in the form of a hydraulic bar linkage in each case. The thrust bar linkage expediently has a fixed bearing and a moved bearing, which, as a result of the thrust movement of the thrust bar linkage, is drawn linearly, that is to say in a straight line, towards the fixed bearing or is pushed away therefrom. The fixed bearing of the thrust bar linkage is expediently fastened fixedly to the container housing and in particular coincides with a housing-fixed rotation point or a fixed axis.

A motor unit is advantageously rotatably mounted, such that the direction of push and/or pull of the thrust bar linkage is rotatable about the fixed bearing. In order to be able to pivot a lever through a wide pivot range with high force transmission, it is advantageous for two motor units to act on the lever, in particular from opposite sides. One thrust bar linkage can thus act in a pushing manner and the other in a pulling manner, such that the forces of the two motor units are added together. To this end, the moved bearing of the two thrust bar linkages is advantageously arranged at least in a pivot range of the lever between the two fixed bearing of the thrust bar linkage.

When launching a missile, it is sensible to keep the jet of waste gas completely out of the internal volume of the container. The internal volume of the container can be understood to mean the volume of the container housing that is surrounded by the housing in the closed state of the container. In order to the keep the jet of waste gas out of this volume when a missile is launched, it is advantageous if the movement mechanism is designed to lift out the canister completely from the container housing into the operating position of the missile, in particular to lift it out from the container housing upwardly. A rear end of the canister, from which the jet of waste gas normally exits, can thus also be taken out from the container housing and therefore removed from the container volume.

Ground-to-air missiles can be launched vertically or upwardly. In this case, the jet of waste gas exits vertically downwardly. In order to avoid an impingement of the jet of waste gas on the container housing or even inside the container housing, it is advantageous if the canister is moved laterally to the side of the container housing. The movement mechanism is expediently designed for this purpose. It is particularly advantageous in this case if, in the operating position, a wall of the container housing is arranged between the canister end and the container interior. The wall acts as a protective shield between the hot jet of waste gas and the container interior and thus shields elements within the interior against the jet of waste gas. The wall of the container housing may be a side wall or a front or rear wall or back wall of the container housing. A rear wall of the container housing positioned opposite a front wall, in which a door for accessing the container housing is arranged, is particularly advantageous.

A canister unit formed from a plurality of canisters, each with a missile, has a considerable weight, as a result of which an anchoring to the container house has to be designed in a stable manner. So as not to allow the force to rest completely on one container wall, it is sensible to arrange the force-absorbing bearings of the container housing as close to one another as possible and to provide force-transmitting connections between the take-up bearings. The closer the take-up bearings are arranged to one another in this case, the more easily can the construction be produced with more rigid connections. In particular if the canister is to be lifted out completely from the container housing and a large pivot movement is therefore necessary, it is difficult to place the take-up bearings closely side by side. This problem can be solved by carrying out the pivot motion with a large pivot angle. To this end, the movement mechanism is advantageously designed in such a way that the canister, in the operating position, is pivoted through at least 210° from its position in the storage position. Due to the pivoting in a large angular range, a large pivot path can also be achieved with take-up bearings arranged close to one another. The pivot is expediently at least 260°, in particular at least 270°. The canister can be brought from a horizontal storage position into a vertical starting position.

Both in the storage position and in the operating position, the canister with the missile will generally be resting for a long time. It is beneficial for operating reliability if, in the two rest states, as little force as possible or no force has to be transmitted from the movement mechanism to the canister and the canister can therefore rest, where possible, set down on a set-down means. The movement mechanism can thus remain free from force and a movement motor can thus remain free from drive. Operation, maintenance or repair of the canister or of the missile can thus be carried out with low risk potential. For this purpose, the missile container expediently comprises a set-down means on which the movement mechanism rests set down in the storage position, and a set-down means on which the movement mechanism rests set down in the operating position.

The invention additionally relates to a method for operating a missile container having container housing and at least one canister stored therein for supporting a missile. In order to be able to efficiently achieve a combat-ready state, it is proposed for the canister to be moved by a movement mechanism of the missile container from a storage position into an operating position.

The movement is preferably implemented by means of a kinematic linkage of the movement mechanism, which in particular has a multi-member kinematic chain.

In accordance with an advantageous embodiment of this invention, the canister is introduced from above into the container housing and is set down therein. A simple loading of the container housing with the canister can thus be achieved. The canister is advantageously set down in the container housing in translation vertically from above. This can be achieved particularly easily by means of a crane.

To fasten the canister to the movement mechanism, the movement mechanism expediently comprises a holding unit having a fastening means in particular for rigid fastening of the canister to the holding unit. For tilt-free fastening of the holding unit to the canister, it is advantageous if the holding unit of the movement mechanism is lowered from above onto the canister and the canister is fastened to the holding unit. The holding unit is also expediently lowered from above onto the canister in translation vertically from above. The canister fastened to the holding unit can be moved on the holding unit from the storage position into the operating position.

During the storage and transport, the canister is expediently set down on a base of the container housing, where it is fastened. In particular, the base, canister and holding unit in the storage position form a fixedly interconnected unit.

It is useful for tilt-free removal of the canister from the storage position, for example from the base, if the canister is moved out from the storage position by means of the movement mechanism in translation. In this case, the movement mechanism moves the holding unit and the canister expediently vertically upwardly. The canister can remain horizontally aligned during the movement in translation. The movement is expediently achieved by a pivoting of the canister about at least one fixed axis, in particular about two fixed axes.

To achieve a good launching position fully outside the container housing, it is advantageous if the canister is rotated from the storage position into the operating position over an angular range of at least 260°, in particular through 270°, about a horizontal axis.

Before launching and in the event of maintenance of the missile, the function of sensors of the missile is tested. In particular, the acceleration sensors and/or rotational speed sensors of an inertial navigation system (INS) can be checked in this case with respect to offset and/or scale factor values. To this end, the corresponding sensor can firstly be brought into a position, tested in this position, then rotated through 180° and tested once again, wherein a position, angle or acceleration offset of the sensor can be established from the two tests. Such tests are complex, since the missiles have to be taken out from the storage container and rotated.

Due to the high movability of the movement mechanism by the linkage, a sensor test can be considerably facilitated. To this end, in accordance with the invention, the movement mechanism moves the canister with a missile arranged therein into two oppositely aligned positions in accordance with the invention. In this case, the missile is expediently rotated about a horizontally aligned axis through 180°. In the two positions, a signal of a sensor in the missile is advantageously detected and a state of the sensor is established from the signal, for example an offset is established. With a movability of the movement mechanism in such a way that the canister can be pivoted through at least 270°, the canister with the missile can be brought into four positions each rotated through 90° relative to one another, such that the sensor measurements can be taken in all four positions. In this way, two pairs of measurements can be taken from opposite positions, that is to say positions rotated through 180°, wherein the position pairs are rotated through 90° relative to one another.

The invention is also directed to a method for operating a missile container having a container housing, in which a missile is introduced in a canister into the container housing and said container housing is closed and the container is stored over a period of time of at least one month, for example. The missile container is then loaded onto a vehicle and taken to a site of operation. At the site of operation, the container housing is opened and the canister is moved from the container housing by a movement mechanism of the missile container and is operated, fastened to the movement mechanism. Such an operation is in particular a launching of the missile from the canister.

The invention is also directed to a system of a plurality of missile containers, each having a container housing, wherein the container housings are stored stacked one on top of the other.

The invention further protects a method, in which a plurality of identical missile containers are operated, wherein one missile container is used on a fixed flooring, for example a concreted surface, another missile container is used arranged on a wheeled vehicle, and in particular a third missile container is operated on a container mounting of a system to be protected. Such an operation is expediently the firing of a missile from a canister of the missile container.

The above-mentioned methods, method features and device features can also each be combined with the last-mentioned developments of the invention.

The description provided above of advantageous embodiments of the invention contains numerous features which are sometimes reproduced in the individual dependent claims combined in multiple. These features will also expediently be considered individually however by a person skilled in the art and combined to form sensible further combinations. In particular, these features can each be combined individually and in any suitable combination with the method according to the invention and the device according to the invention in accordance with the independent claims.

The above-described properties, features and advantages of this invention, and also the way in which these are achieved can be understood clearly and explicitly in conjunction with the following description of the exemplary embodiments, which will be explained in greater detail in conjunction with the drawings. The exemplary embodiments are used to explain the invention and do not limit the invention to the combination of features specified therein, including with respect to the functional features. In addition, features of any exemplary embodiment suitable for this purpose can also be considered explicitly in an isolated manner, removed from an exemplary embodiment, introduced into another exemplary embodiment for supplementation thereof, and/or combined with any one of the claims.

DETAILED DESCRIPTION OF THE INVENTION

Figure 1:
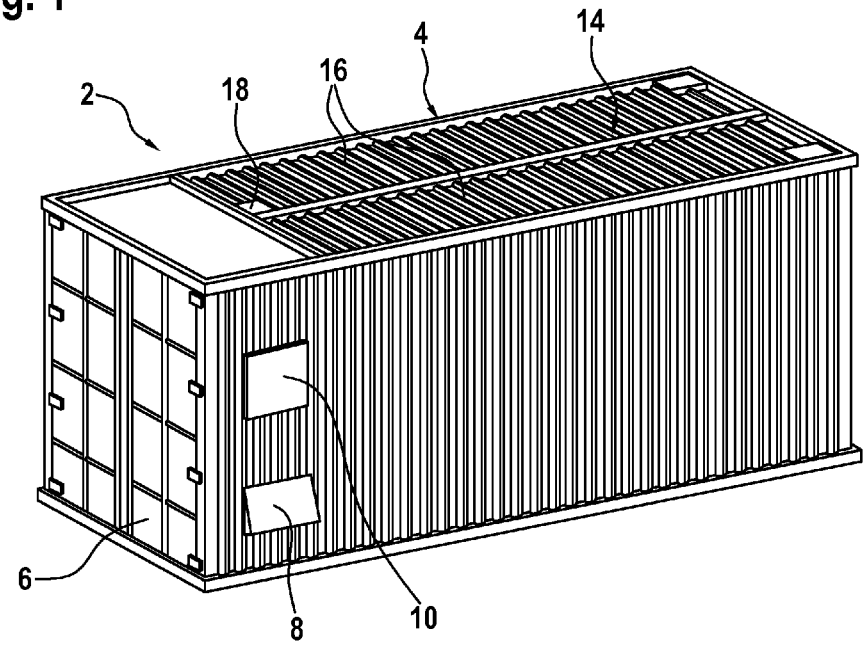
FIG. 1 shows a missile container in a storage or transport state with closed container housing.

Referring now to the figures of the drawing in detail and first, particularly, to FIG. 1 thereof, there is shown a missile container 2 having a closed container housing 4. The container housing 4 has the dimensions of a standard 20-foot container and also contains the standardized fastening recesses and fastening means for fastening to other 20-foot containers and appropriate loading devices. On its front side, the container housing 4 comprises an access door 6 for entering a container interior, the door being formed similarly to conventional container doors. From the outside, the missile container 2 likewise corresponds in terms of shaping and design to a 20-foot ISO transport container, also referred to as a 6.1 meter intermodal container. As is conventional for example with cooling containers, the missile container 2 comprises an interface 8 for connection to a power supply, wherein one or more further connections are also optionally possible, for example a data connection. The missile container 2 further comprises a cover 10, by means of which a display and input device 12 (see FIG. 3) arranged there behind is externally protected.

On its upper side, the container housing 4 has a container roof 14 with two symmetrical roof wings 16, each extending over more than one half the length of the missile container 2. At the rear end of the container roof 14, two roof flaps 18 are arranged and are illustrated in an enlarged view in FIG. 2.

Figure 2:
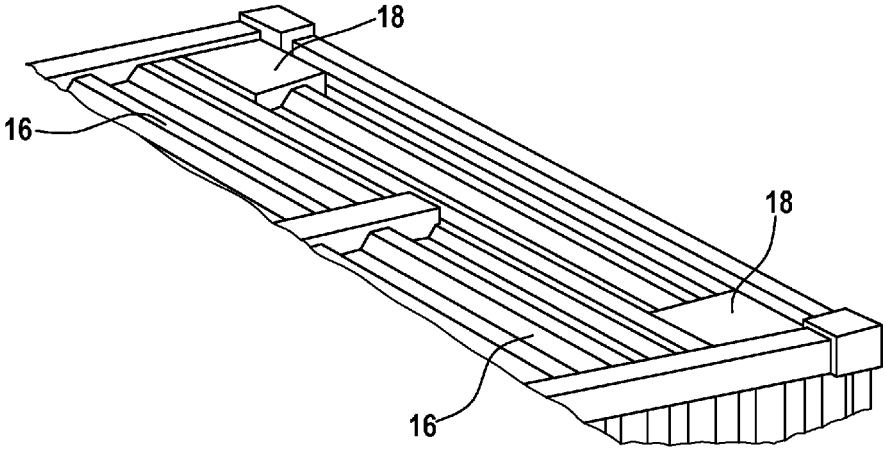
FIG. 2 shows a detail from the container roof of the missile container from FIG. 1.

FIG. 2 shows a detail of the rear container roof 14 of the missile container 2. The two roof flaps 18 arranged at the rear end of the container roof 14 each border a roof wing 16 and, similarly to the roof wings 16, are to open such that a roof opening released by the roof wings 16 borders the roof opening released by the roof flaps 18 such that a single large roof opening is produced.

Figure 3:
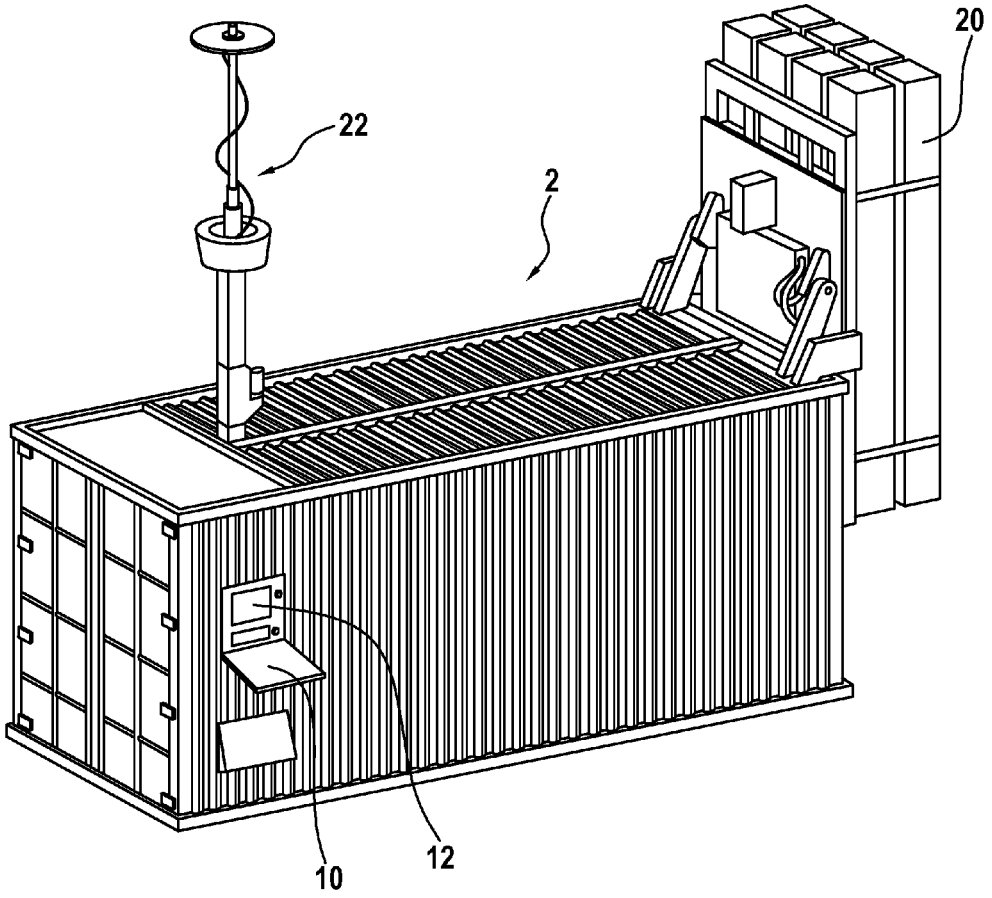
FIG. 3 shows the missile container in an operating position, likewise with closed container housing.

FIG. 3 shows the missile container 2 likewise in a closed state, the container housing 4 is therefore closed, however canisters 20 and missiles stored therein are held outside the container housing 4 and are arranged in an operating position. An antenna 22 is also folded out and is located outside the container housing 4. The cover 10 is open, such that a display and input device 12 arranged therebehind is accessible.

Both in the state shown in FIG. 1, in which the canisters 20 are stored in a storage position within the container housing 4, and in the state shown in FIG. 3, in which they are arranged outside the container housing, the missile container 2 is closed insofar as the container interior, which is enclosed by the container housing 4, is largely protected against weather influences of the surrounding environment. The container housing 4 is thus rainproof and splashproof and also impervious to sand and dust in the two states, such that elements in the container interior are protected against these influences.

The state of the missile container 2 shown in FIG. 1 is a storage and transport state, in which the container housing 4 is firmly closed and protects the device in the container interior. By contrast, the state shown in FIG. 3 is an operating state of the missile container 2, in this case a combat state or combat-ready state. The missile container 2 may also remain in this state for a long time without the device in the container interior being exposed to the corresponding external influences, for example rain or, at high wind, blown sand. In the operating position, the canisters 20 are vertically aligned with the front side of the canisters pointing upwardly, such that the missiles stored in the canisters 20, when their rocket driving mechanism is launched, exit upwardly from the corresponding canister 20 by means of the rocket thrust and are launched vertically upwardly.

In order to minimize the aftereffects of the jet of waste gas of the launching missile on the container housing 4, the canisters 20 are arranged outside the container housing 4 and are additionally positioned at a suitable height above the ground. The height of the lower edge of the canisters 20 is at least 80 cm, in particular at least 1 m. The container rear wall, which is not shown in the figures, is always closed, such that gases of the hot jet of waste gas do not infiltrate the interior of the container housing 4.

The missile container 2 can be used universally. It can be used both standing on a fixed flooring and on a commercial vehicle. A use on a ship or other objects to be protected, for example an oil platform, is also easily possible.

Figure 4:
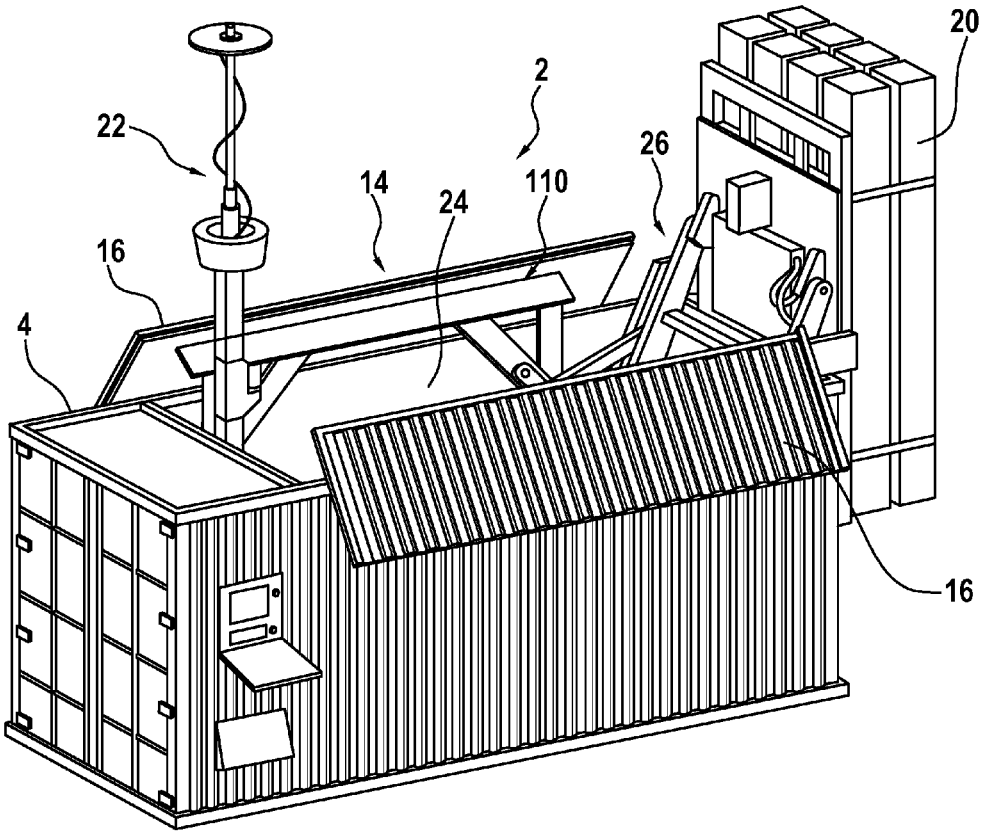
FIG. 4 shows the missile container with canisters held in the operating position and with open container roof.

FIG. 4 shows the missile container 2 in an operating position of the canister 20, but with open container roof 14. The two roof flaps 16 are pivoted upwardly and to the side and thus release a roof opening 24 of the container housing 4. The canister 20 in the container interior can be moved out again from the container interior through this roof opening 24. To this end, the missile container 2 comprises a movement mechanism 26, which is illustrated more clearly in FIG. 5 by the cut-away illustration of the missile container 2.

Figure 5:
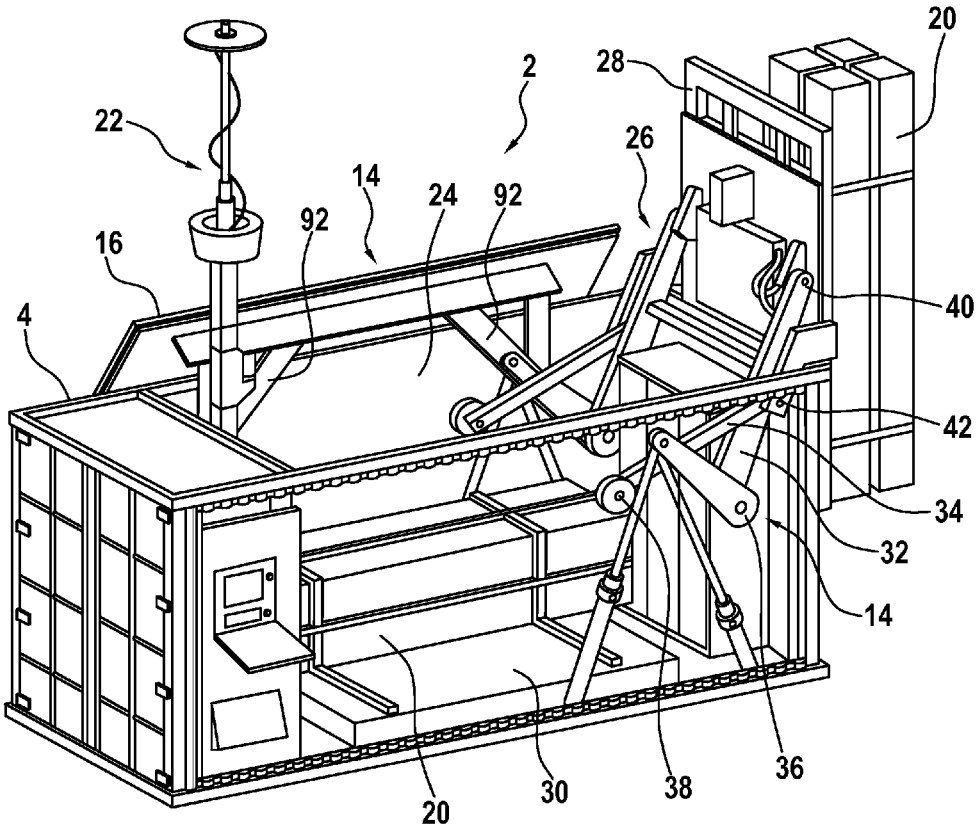
FIG. 5 shows the missile container from FIG. 4 in a partly cut-away view.

FIG. 5 shows the missile container 2 from FIG. 4 in an illustration in which a side wall of the container housing 4 is cut away and is therefore illustrated in an open manner. For the sake of improved clarity, one of the roof wings 16 has been omitted in the illustration. In addition, only four of the eight canisters are fastened to a holding unit 28 of the movement mechanism 26 and are used in the state shown in FIG. 3. The other four canisters 20 are arranged in the storage position in the container interior and rest on a base 30 of the missile container 2. In this respect, FIG. 5 shows a loaded state of the missile container 2, in which the stored canisters 20 are already introduced into the missile container 2, but are not yet fastened to movement mechanism 26.

The movement mechanism 26 comprises a kinematic linkage, which in this embodiment has two axially symmetrical units on both longitudinal sides of the container. Here, a side wall of the container constitutes the stationary part of the linkage in each case. The holding unit 28 forms the movable part of the linkage and is connected to or forms the two rockers or coupling members of the two units of the linkage.

The two units of the movement mechanism 26 are each formed as a linkage 46 in the form of a four-member kinematic chain. The container housing 4 is used as a housing member or stationary housing element. The holding unit 28 serves both units as a coupler or coupling member or operating member. The linkage 46 comprises a leverage having four housing-fixed rotation points.

Each linkage 46 comprises two movable members 32, 34 in the form of rigid elements, for example rods. Each of the movable members 32, 34 is connected at a housing-fixed point of rotation 36, 38 to the housing member or the container housing 4 in a rotatable, but otherwise stationary, manner. The movable members 32, 34 are also connected via movable rotation points 40, 42 to the operating member or the holding unit 28. The rotation points 40, 42 are in this case mounted rigidly relative to the coupling member or the holding unit 28.

Parts of the linkage 46 are located next to the holding unit 28. This embodiment permits narrow elements, such that a very broad holding unit 28 can be used or the arrangement of movement mechanism 26 and canisters 20 can be formed in a particularly compact manner.

Figure 6:
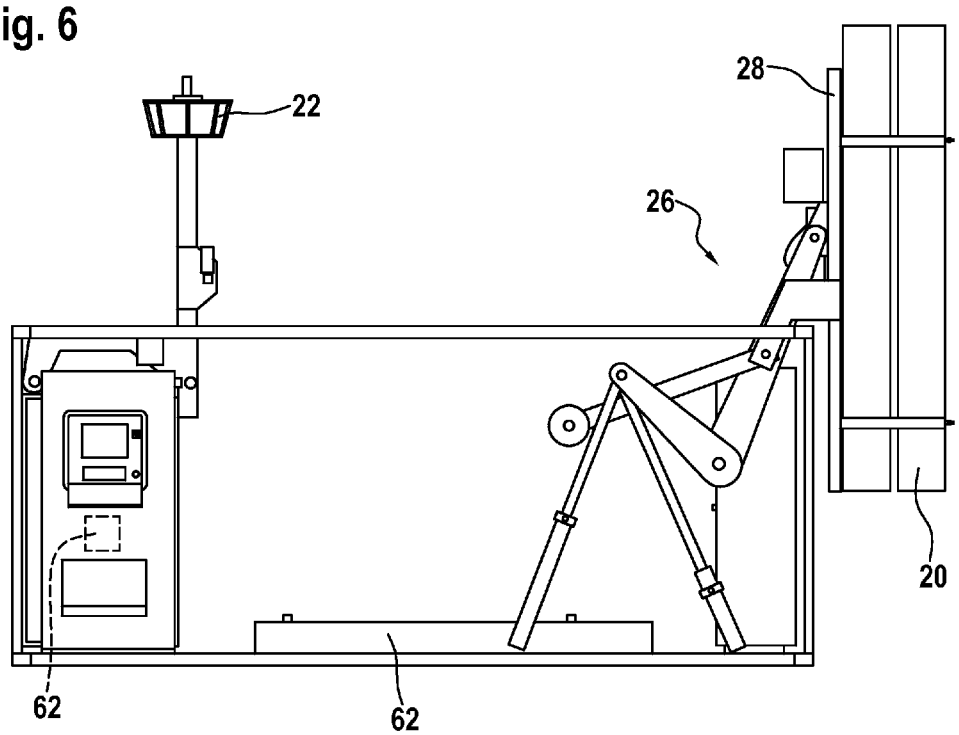
FIG. 6 shows a schematic side view of the missile container with canisters in the operating position.
Figure 7:
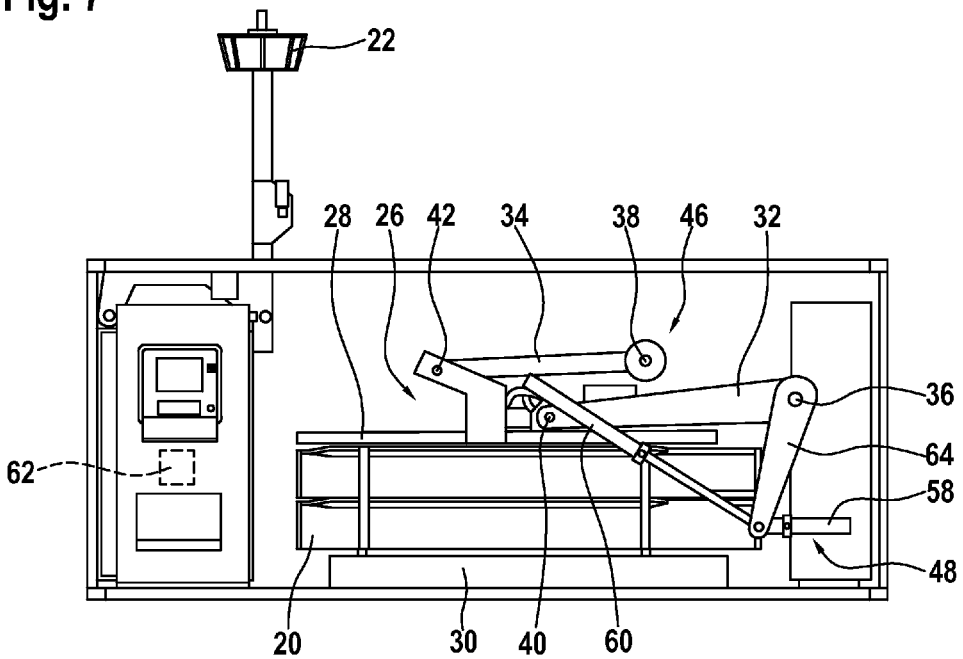
FIG. 7 shows the missile container from FIG. 6 with canisters in the storage position.

The linkage 46 is illustrated from the side in FIGS. 6 and 7, such that the front unit covers the axially symmetrical rear unit. FIG. 6 shows the canisters 20 in this case in the same position as FIG. 5, wherein, in contrast to FIG. 5 however, all canisters 20 are arranged on the movement mechanism 26. FIG. 7 shows the movement mechanism 26 and the canisters 20 in the storage position. The canisters 20 are set down on the base 30, for example are inserted there, and the movement mechanism 26 is fastened to the canisters 20.

Figure 11:
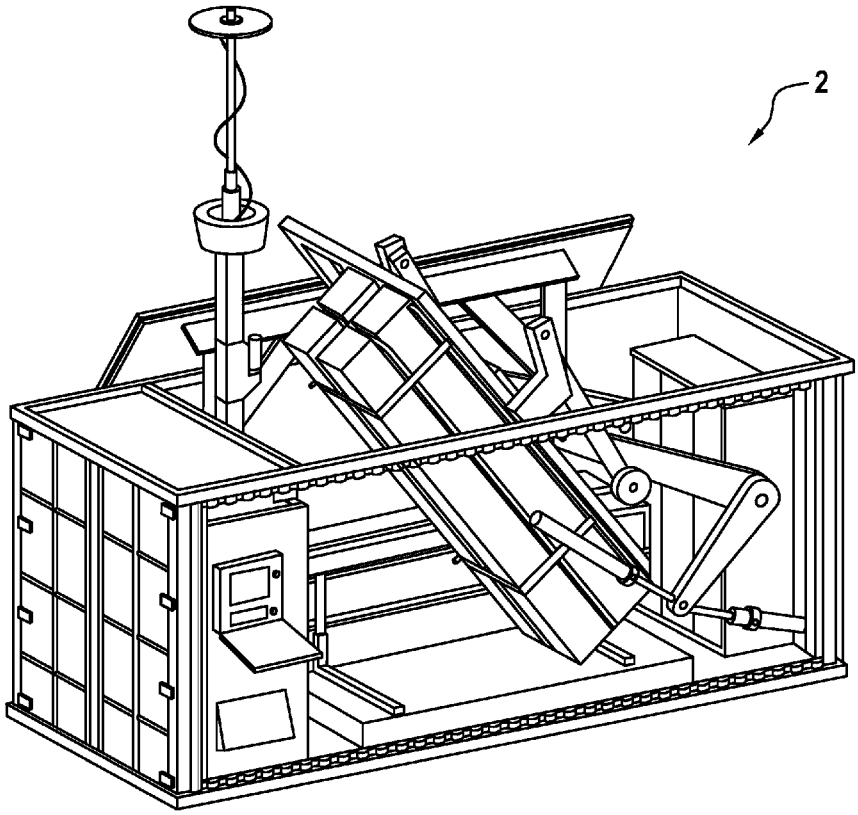
FIG. 11 shows the canisters as the pivoting process is continued further.
Figure 12:
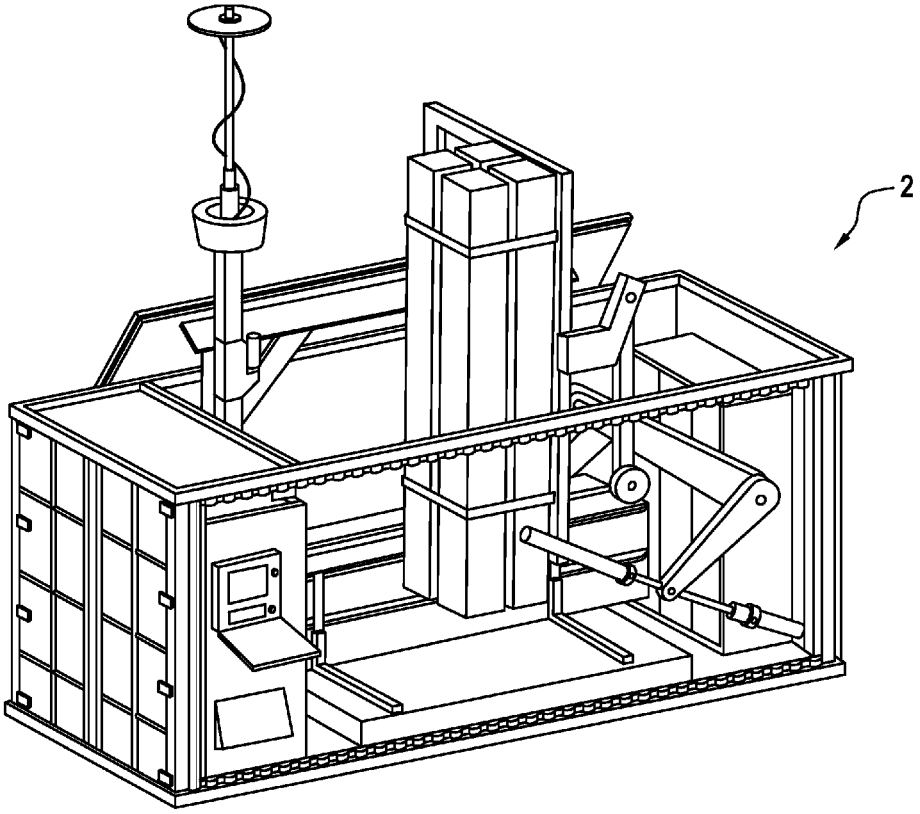
FIG. 12 shows the canisters aligned vertically and with the rear-wall end pointing upwardly.
Figure 13:
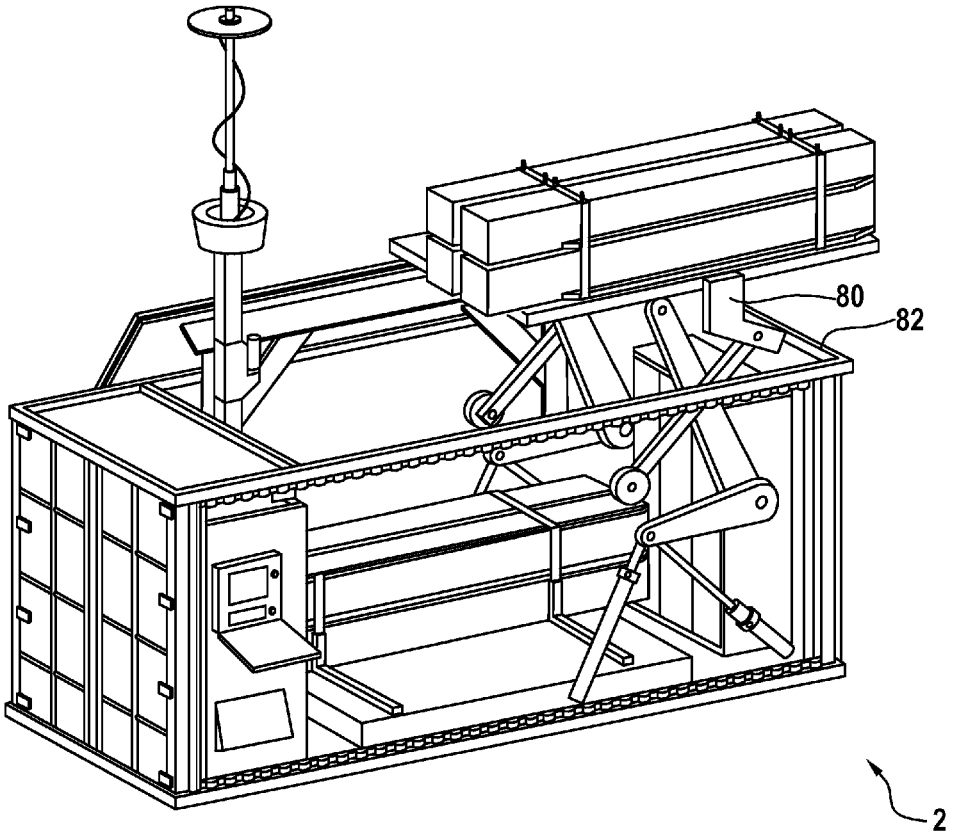
FIG. 13 shows the canisters fully lifted out from the container housing and in a horizontal position.

In FIGS. 8 to 13, a course of movement of the movement mechanism 26 or of the canisters 20 from the storage position into the operating position is illustrated, wherein the operating position from FIG. 5 is to be considered as the end of the last region of the course of movement between the positions from FIG. 13 and FIG. 5. The movement paths of this course of movement are reproduced schematically in FIGS. 14 and 15. Such a course of movement is described hereinafter.

Figure 8:
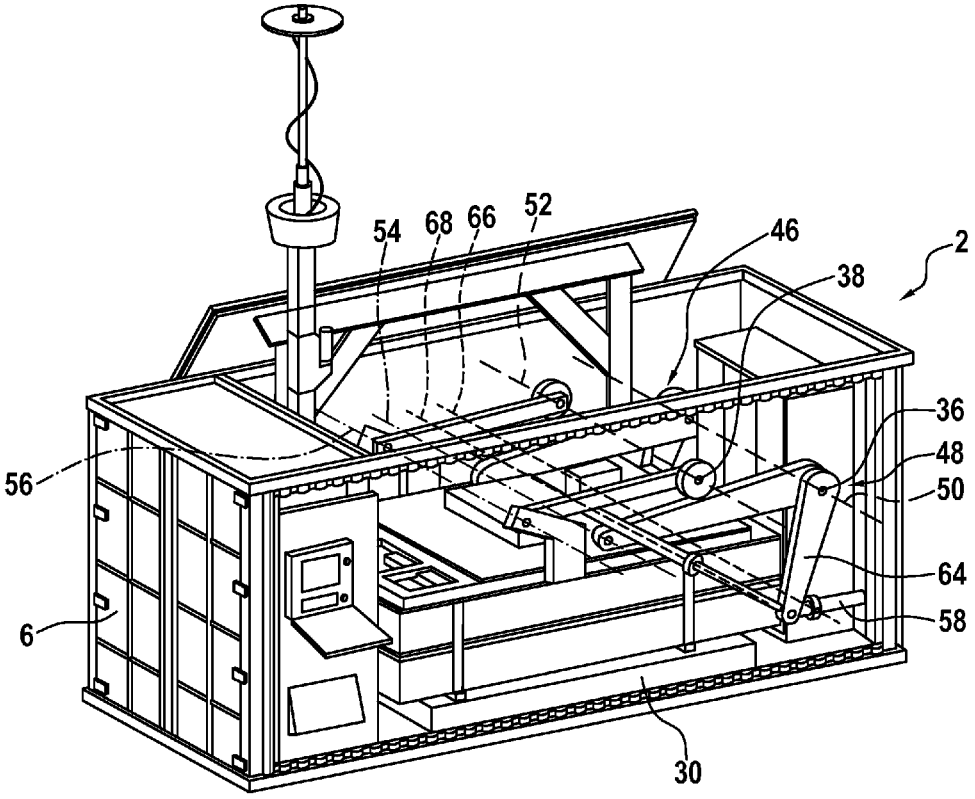
FIG. 8 shows the missile container from FIG. 5 with canisters in the storage position.

FIGS. 7 and 8 show the canisters 20 or the movement mechanism 26 in the storage position. In this position, the canisters 20 are connected at least in a form-fitting manner to the container housing 4, for example via the base 30, such that a horizontal movement of the canisters 20 relative to the container housing 4 is blocked. The movement mechanism 26 or its holding unit 28 is lowered from above towards the resting canisters 20 and is connected thereto such that the canisters 20 are rigidly connected to the holding unit 20 in all directions.

Figure 9:
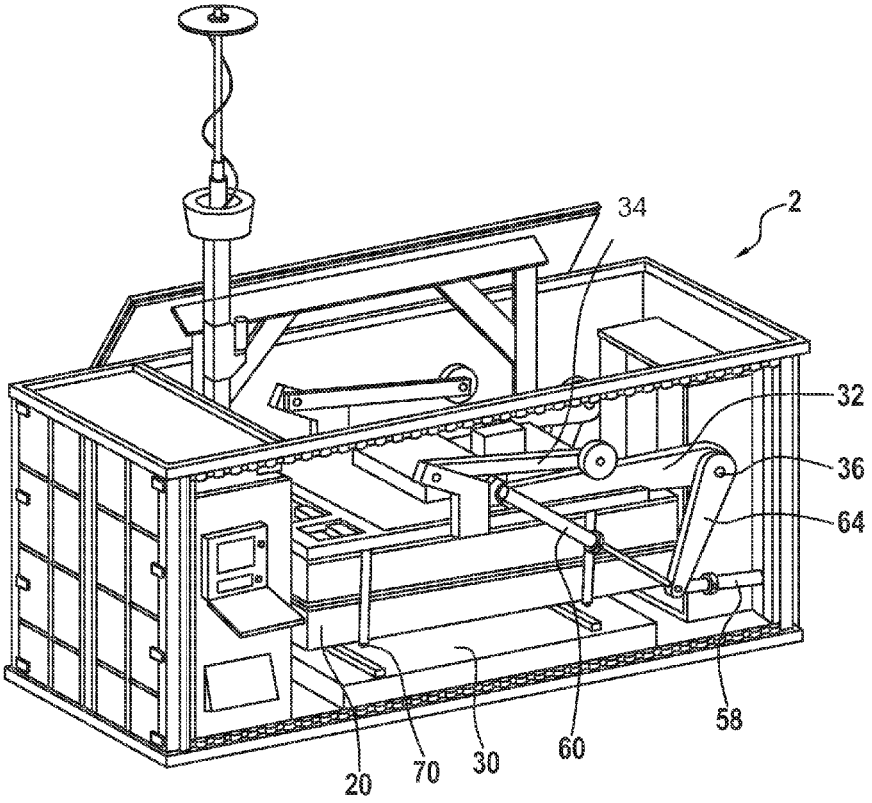
FIG. 9 shows the missile container from FIG. 8, in which the canisters are lifted from the storage position vertically upwardly.

A first part of the course of movement is illustrated by FIGS. 8 and 9. The canisters 20 are lifted upwardly slightly from the base 30. This is achieved in that a movement motor 48 of the movable member 32 rotates about the rotation point 36. It can be seen from FIG. 8 that the two units or linkages 46 are arranged opposite one another in the container housing 4, such that their two rotation points 36 form a fixed axis 50, about which the movable member 32 of both linkages 46 is rotated. In FIG. 8, a further fixed axis 52 is indicated and interconnects the two housing-fixed rotation points 38. The two movable members 34 of the two linkages 46 rotate about this fixed axis 52. Both fixed axes 50, 52 are illustrated in FIG. 8 by long dashes.

Due to the rotation of the movable members 32 of the linkages 46, the movable rotation point 40 thereof also rotates about the housing-fixed rotation point 36. The two movable rotation points 40 form a pivot axis 54, which runs through the two movable rotation points 40 and is illustrated in FIG. 8 by a dot-and-dash line. A further pivot axis 56, which runs through the rotation points 42 of the movable members 34 of the two linkages 46 is also illustrated by a dot-and-dash line. This pivot axis 56 rotates in a circular manner about the fixed axis 52.

The degree of freedom of the movement of the holding unit 28 or of the canisters 20 with respect to the container structure or the stationary container housing 4 is implemented merely by means of rotary joints. Each linkage 46 therefore produces the curve-line movement merely from pivoting movements about two stationary fixed axes 50, 52.

The movement of the movement mechanism 26 is generated by two movement motors 48, wherein each linkage 46 is assigned a movement motor 48. Each movement motor 48 comprises two motor units 58, 60, which are both formed as thrust bar linkages. In the shown exemplary embodiment, both motor units 58, 60 are hydraulic cylinders, which are connected to a hydraulic pump and are controlled by a control means 62. The hydraulic cylinders act directly on the main bearing member 32 of the linkage 46. The driving power is transmitted via four hydraulic cylinders, two on each side. In the event of a hydraulic leak, the holding unit 28 can therefore be stopped in any position in order to avoid subsequent damage.

The two motor units 58, 60 each act on a single lever 64 of the linkage 46 that is connected rigidly to one of the movable members 32, 34, that is to say the movable member 32 in the exemplary embodiment shown in the figures. The drive for the movement of the movement mechanism 26 acts only on one transmission element, in this case the movable member 32. Both motor units 58, 60 generate the movement of the movement mechanism 26 by a change in length, that is to say a contraction and expansion. In this case, both motor units 58, 60 can generate the movement force exclusively by expansion, or at least one of the motor units 58, 60 is additionally designed to apply movement force into the movement mechanism 26 by contraction. This is the case here with the motor unit 60.

In the present exemplary embodiment, each movement motor 48 comprises exclusively motor units 58, 60 which are effective in a length-variable manner and which are each pivotable about a fixed axis 66, 68. These two fixed axes 66, 68 are illustrated in FIG. 8 by short dashes and connect the corresponding motor units 58 and 60 of the two movement motors 48. It is also possible however to produce the movement of the movable member 32 by another movement motor without such fixed axes 66, 68.

The bearing mounts for the fixed rotation points 36, 38 and those for the rotation points of the motor units 58, 60 lie together in a relatively small region, such that the necessary highly loaded structure regions are not to be guided over large distances. A four-sided shape formed by the four fixed axes 50, 52, 66, 68 in this case comprises a maximum extension that is smaller than half a canister length.

Due to the drive of the two movement motors 48, the canisters 20 move in translation from the storage position shown in FIG. 8 away from the base 30, in this exemplary embodiment vertically upwardly. Such a movement in translation has the advantage that holding members 70, which ensure the fixing of the canisters 20 on the base 30, can be removed in a tilt-free manner from the base 30 or the canisters 20. In the exemplary embodiment shown in the figures, a holding member 70 engages in a recess in the base 30, and the holding member 70 is thus drawn from the corresponding recess by the movement in translation upwards.

Figure 14:
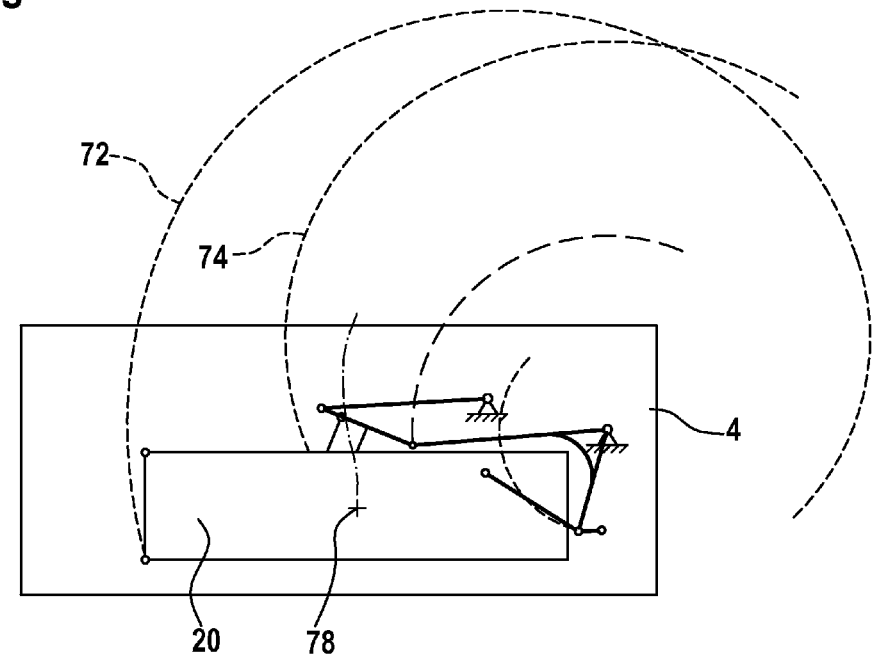
FIG. 14 shows a schematic side illustration of the container housing and the canister in the storage position with movement curves of the canister of its movement from the storage position into the operating position.
Figure 15:
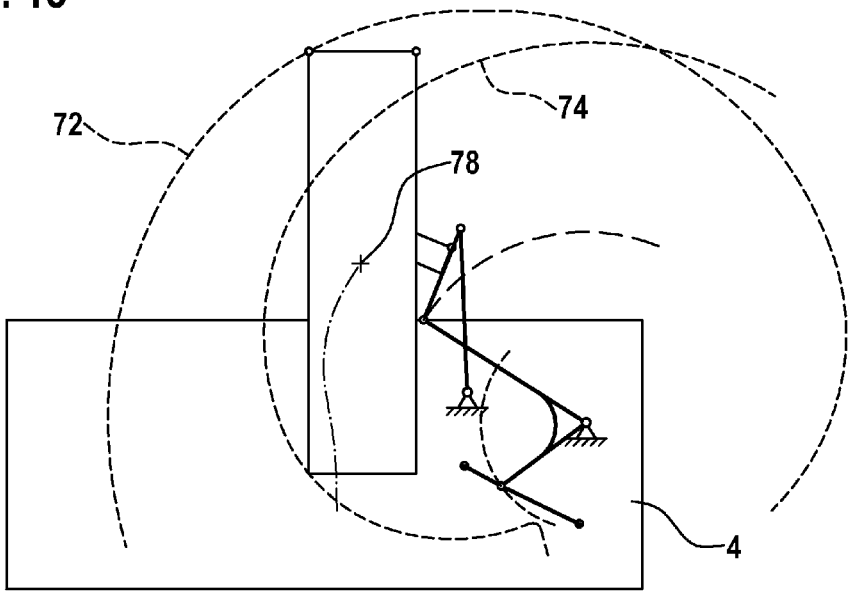
FIG. 15 shows the canister from FIG. 14 in a position rotated through 90° over the indicated movement paths.

This movement in translation is illustrated in FIGS. 14 and 15 by the start of the movement paths 72, 74, which are illustrated in FIGS. 14 and 15 in a dashed manner. The movement path 72 of the front lower end of the canister 20 and the movement path 74 of the rear lower end of the canister 20 are illustrated. From the front movement path 72, it can be seen that the front side of the canister is moved substantially vertically upwardly, wherein an angular deviation of up to 20°, in particular up to 10°, is harmless and is also included in this context by the term "vertical translation". From the rear movement path 74, it can be seen that the rear end of the canister 20 is also initially lifted upwardly, such that the movement in translation is produced from the upwards lifting of the front and rear end of the canister 20. As can be seen from FIG. 15, the first part of each of the two movement paths 72, 74 are parallel to one another, thus producing the movement in translation, in this exemplary embodiment substantially vertically upwardly. This translation part of the movement runs over at least 110 cm, in particular over at least 15 cm. To ensure reliable release, even with relatively large holding members 70, the translation part of the movement shown in FIG. 15 is approximately 25 cm.

Whilst the front end of the canister 20 is lifted continuously upwardly as its movement continues, the movement of the rear part of the canister 20 after the translation phase makes a sharp deflection of at least 60°, in the exemplary embodiment shown even of 90°. The translation phase transitions into a rotation phase of the canister 20. In the rotation or pivot phase, the part of the canister 20 arranged to the rear in the storage position moves substantially horizontally. The transition between vertical and horizontal movement is shorter than the movement in translation, in the shown exemplary embodiment just a few centimetres.

The transition from the translation movement phase to the rotational movement phase of the canister 20 occurs very sharply, as can be seen from the movement paths 72, 74 from FIG. 15. This sharp transition is advantageous, since an absolutely exact movement in translation can be used initially to release the canister 20 from the container housing 4, for example from the base 30. The rapid onset of the rotational movement phase leads to a relatively low volume requirement of the overall movement of the canister 20 from its storage position into its operating position. Due to this type of movement, the movement can therefore not only be kept compact, but a relatively large amount of space of the container housing 4 can also be used for other objects, for example switch cabinets 76, such that a compact design of the missile container 2 is enabled on the whole.

The movement of the canister 20 vertically upwardly is enabled by the position of the fixed axis 50 relative to the pivot axis 54 and of the fixed axis 52 relative to the pivot axis 56. The two axis pairs formed of fixed axis 50 and pivot axis 54 and fixed axis 52 and pivot axis 56 each form a plane that is arranged substantially horizontally. The first part of the movement paths 72, 74 thus takes place by a lifting of the two pivot axes 54, 56 substantially vertically upwards. The movement in translation can be achieved by the high degree of parallelism of these two planes in the storage position. Due to the different lengths of the two movable members 32, 34, this parallelism disappears over the course of the movement, whereby a pivoting of the canister 20 occurs. This only occurs however when the movable member 32 or the plane formed from the fixed axis 50 and the pivot axis 54 has moved away from the horizontal.

A further criterion of the movement paths 72, 74, which leads to a low space consumption of the movement paths 72, 74 or of the canister 20 over the course of its movement is that the geometric center of gravity 78 of the canister 20 not only moves vertically upwards during the translation phase of the movement, but also during the first part of the rotational movement. This is shown in FIGS. 14 and 15 by the dot-and-dash line of movement of the center of gravity 78. This movement path of the center of gravity 78 remains substantially vertical until the center of gravity 78 has left the container housing 4. Only then does a significant pivoting of this rotation point path from the straight line, and in particular from vertical, start. During the phase of the rotation point path within the container housing 4, a deviation of up to 20%, in particular up to just 10% at most, in a direction transverse to the primary direction of movement of the rotation point 78, therefore in the shown example at most 10% to the front, rear or side relative to the primary movement upwardly, is still to be considered as a straight path and in particular a vertical path.

Figure 10:
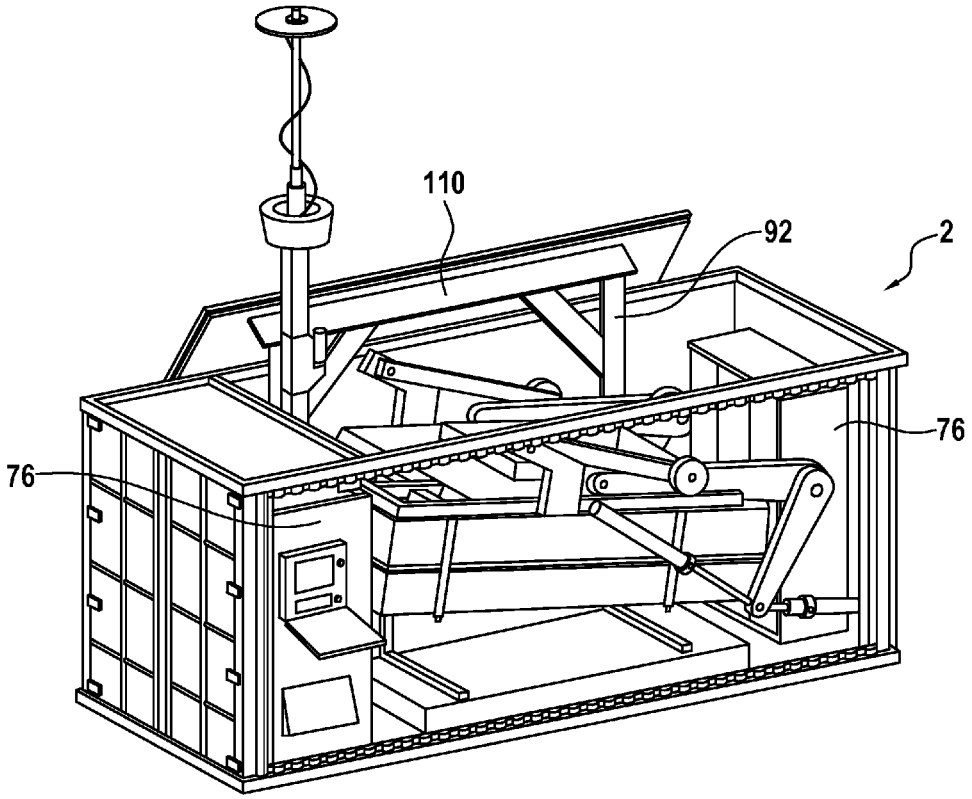
FIG. 10 shows the canisters with a starting pivoting process.

As can be seen from FIGS. 10 to 12, the translation movement phase of the canister is followed by a pivot phase, during which the canister 20 with a relatively small movement is strongly pivoted upwardly, specifically through 90°. During this phase, not only is the gravitation and therefore the gravitational force of the canisters 20 and the moving parts of the movement mechanism 26 to be overcome by the movement motors 48, but the strong pivoting movement is also to be carried out, which starts relatively efficiently after the translation movement phase and therefore a certain moment of inertia opposes the movement motors 48. In this regard, the greatest application of force for the movement motors 48 is to be provided during the first 90° pivoting of the canisters 20. For this purpose, the motor units 58, 60 are arranged relative to one another such that they act on the lever 64 in a mutually opposed manner during this phase and can thus apply forces particularly well. This is also true in particular because both thrust bar linkages are extended to a relatively short extent in this phase and the motor units 58, 60 are thus still in their most powerful pushing or pulling phase. The motor unit 58 in this case acts by pushing, and the motor unit 60 acts by pulling, wherein the motor unit 60 is also designed to apply a force by means of thrust, as is apparent in the movement phase shown in FIG. 13. From a rotation of approximately 180°, the motor unit 60 also acts by pushing on the lever 64 and thus brings the canisters 20 into their operating position, as is illustrated in FIG. 5.

To carry out a return movement from the operating position into the storage position, the motor unit 60 acts by pulling, whereas the motor unit 58, which is designed only to act by pushing, is entrained passively. The fact that only one of the motor units 58, 60 introduces the motor-driven force into the linkage 46 is not critical, since the load of the canisters 20 and of the holding unit 28 only has to be lifted slightly in order to reach the highest position, from which no more force pulling the canisters 20 has to be applied during the further course of the rearward movement.

Both in the operating position shown in FIG. 5 and in the storage position shown in FIG. 8 of the canisters 20 or of the movement mechanism 26 can the movement motors 48 remain held in a force-free manner. In the storage position, this is possible as can be easily seen, since the movement mechanism 26 is set down on the container floor or the base 30. Even in the operating position is the movement mechanism 26 set down however, in this exemplary embodiment on a set-down surface 82, for example the upper side of the rear container wall, as can be seen from FIG. 5. In this case, the underside of a supporting arm 80 of the movement mechanism 26 or of the holding unit 28 is located on the upper side (see FIG. 13) of the rear container wall. The gravitational force of the canisters 20 and of the holding unit 28 in this case holds the movement mechanism 26 and the canisters 20 in the operating position. Also in this position, the movement motor 48 can thus be held without force, and the canisters 20 remain securely in their operating position. The two inherently stable positions, that is to say the storage position and the operating position, have the advantage that an operator can enter the container housing 4 without risk and the movement motors 48 can be switched off without any risk posed by the movement mechanism 26 or the canisters 20. The hydraulic lines are also pressure less and are therefore safe.

During the entire course of movement from the storage position into the operating position, the canisters 20 perform a rotation through 270°. They are therefore not only lifted from the horizontal position into the vertical position, but are additionally rotated through 180°. This form of movement has the advantage that it is very compact and therefore has only a low spatial requirement, both inside and outside the container housing 4. In addition, it has the advantage that the rear side of the canisters faces away from the linkages 46 and the movement motors 48. This side is particularly easily accessible, and therefore this side is easily and quickly accessible when entering the container housing 4 or the container through the access door 6. Since conventional interfaces are rather located at the rear end of the canister 20, these can be easily connected.

For operation of the missile container 2, this is to be loaded with an operating object, for example a canister 20. Instead of the canister or canisters 20, other operating objects can also be used rather generally for the operation of the missile container 2. In this regard, the missile container 2 and operation thereof are not restricted to one or more canisters 20, but other operating objects can also be used, for example other holders for one or more missiles or other objects.

To load the missile container 2 with a canister 20 or another operating object, an operator can firstly open the cover 10 and activate the control means 62 via the input means 12. The operator then opens the container roof 14 by opening the roof wings 16, expediently via the input means 12 and the control means 62. To load the container housing 2 with an operating object, referred to hereinafter in a simplified manner as a canister 20, the operator can now move the movement mechanism 26 such that a set-down surface for the canisters 20, in the shown exemplary embodiment the base 30, is free in order to set down the canister 20 thereon. To this end, the movement mechanism 26 can be moved away from its storage position shown in FIGS. 7 and 8, for example into the operating position, which is illustrated in FIGS. 5 and 6. Canisters 20 are not yet fastened to the holding unit 28 at this moment in time.

A canister 20 can then be lowered from above into the container housing 4, for example using a crane. In this case, the roof opening 24 is opened to such an extent that the canister 20 can be lowered vertically from above onto the resting surface in the container housing 4, that is to say for example the base 30. In order to assist this set-down process, the operator can open the access door 6 of the container housing 4 and enter the interior of the missile container 2. The operator can thus use his hand to guide the canisters 20 fastened to crane ropes, for example, such that the holding members 70 are connected in a form-fitting manner between canister 20 and base 30, and the canister 20 is thus held in the storage position in a correctly positioned manner.

In this case, it is expedient if only part of the canister 20, which the holding unit 28 is designed to support, is introduced into the container housing 4. This is illustrated in FIG. 5, wherein it should be imagined that the missile canisters 20 on the holding unit 28 are not there. There is thus still sufficient space remaining within the container housing 4 for the operator to stand to the side of the canisters 20 and to thus guide the canisters 20 well into their storage position. Instead of the base 30, another suitable set-down unit can also be used. The loading position, in which one or more canisters is/are set down in the container housing 4 for connection to the holding unit 28 may also differ from the storage position. In the exemplary embodiment shown in the figures, the storage position is identical to the loading position however.

If the canister or canisters, in the exemplary embodiment four canisters 20 are shown, is/are set down in their loading position in the container housing 4, the operator can thus leave the container housing 4 again and allow the movement of the movement mechanism 26 towards the set-down canisters. This occurs expediently via the input means 12 and the control means 62, which expediently controls all movements of the movement mechanism 26. To this end, the control means 62 expediently comprises one or more control programs and electronic elements, such as a processor and data memory, which are necessary to run the control programs.

The holding unit 28 is guided in translation towards the lying canisters 20, as shown by the movement paths 72, 74 from FIG. 15, in the shown exemplary embodiment in translation vertically from above. Fastening means on the canister 20 and/or the holding unit 28 can thus be brought reliably into a holding position in which the canister 20 is firmly connected to the holding means 28. The holding means may be a detent means, which, as the holding unit 28 moves towards the canister 20, latches in such a way that the canister 20 is firmly connected to the holding unit 28.

The operator can now move the movement mechanism 26 into a loading position or, as is shown by way of example in the figures, into the operating position. In this position, the holding unit 28 is then located only with part of the canister that the holding unit 28 is designed to support. This is illustrated for example in FIG. 5.

A further canister 20 or further assembly comprising a plurality of canisters 20 can then be set down in the container housing 4, as described above. This situation is illustrated precisely in FIG. 5. The holding unit 28 can then be lowered again onto the stored canisters 20 and fastened thereto such that the holding unit 28 is then fully equipped. The missile container 2 is fully loaded and the loading process can be terminated as a result of the operator closing the container roof 14 again and protecting the display and input device 12 by the cover 10. The missile container 2 is then ready for transport or a relatively long period of storage.

To produce a state ready for operation, for example a combat-ready state of the missile container 2, this is expediently brought to a site of operation, for example to a building to be protected, to an oil platform, to a ship, to a commercial vehicle, or is placed on a floor, the possibilities for use being rather versatile. An operator can then open the cover 10 and activate the control means 62 via the input means 12, expediently using a protected access code. The container roof 14 is opened by pivoting out the roof wings 16, the antenna 22 is folded out, and the movement mechanism is brought from the storage position into the operating position, for example as described above. The canisters 20 or the missiles stored therein are now ready for operation, for example a launching.

A maintenance operation of the missile container 2 can likewise be carried out easily and efficiently. An operator can thus enter the interior of the container housing 4 by the access door 6 and inspect the canisters 20, for example. Since the rear face or front face of the canisters 20 are additionally facing towards the access door 6, interfaces on the canisters 20, which are conventionally located at their rear end, can be easily checked, or a checking device can be easily connected.

Sensors of the missiles can also be tested easily and quickly with the aid of the movement mechanism 26. For example, if a position sensor, a direction sensor, an inertial navigation system, an acceleration sensor or the like is to be checked, it is thus advantageous to read out measured values of this sensor at different positions of the missile or of the canister 20 storing the missile. For this purpose, the canister 20 can be moved for example into the four positions shown in FIGS. 8, 12, 13 and 5, in which the canister is in each case tilted by 90° to the other adjacent positions. Measured sensor values can be recorded, and an offset or scale factor of the sensor can be checked or established.

In order to bring the missile container 2 from its storage state into its combat state or operating state, the container roof 14 has to be opened in order to be able to guide the canisters 20 out from the container housing 4. To this end, the missile container 2 comprises roof elements, in the shown exemplary embodiment these are formed as roof wings 16, of which the function and movement will be explained hereinafter.

Figure 16:
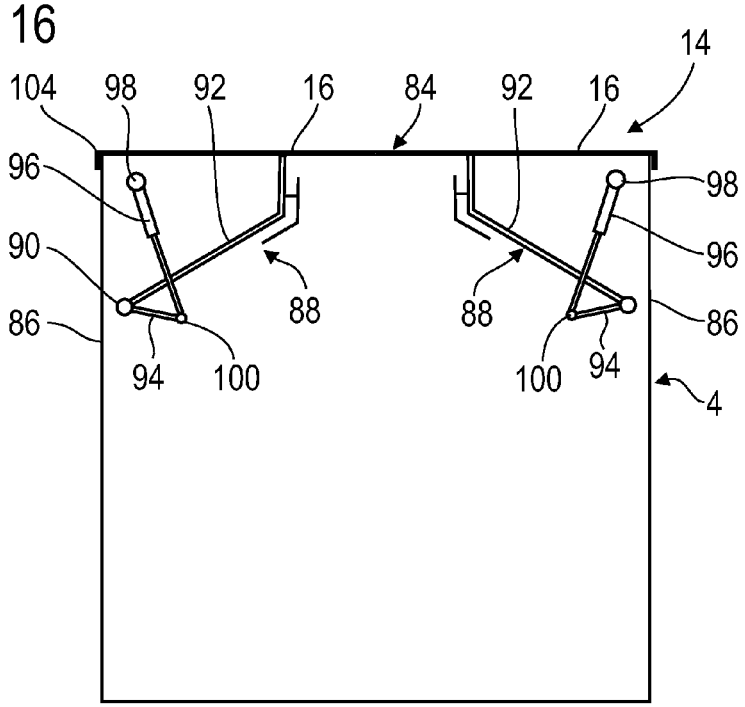
FIG. 16 shows a schematic illustration of two roof wings for opening and closing the container roof of a missile container from the previous figures.

FIG. 1 shows the roof wings 16 in a closed position, in which the container roof 14 is closed and the missile container 2 is sealed in a splashproof manner. This position of the roof wings 16 is reproduced in a schematic and simplified manner in FIG. 16. The container roof 14 has a movable roof unit, which in this exemplary embodiment comprises the two movable roof wings 16. The roof wings 16 each rest on a side wall of the container housing 4 of the missile container 2 and are supported inwardly by an opening means 88. The opening means 88 comprises a linking element 92, which is rotatable about a fixed axis 90 and is movable via a lever 92 by a motor unit 96.

The position of the fixed axis 90 is located in the inner volume of the container housing 4, such that the joint axes of the fixed axes 90 are arranged protected in the inner region of the missile container 2. The axes of rotation 90 of the roof wings 16 are located considerably below the roof line and within the container housing 4. The roof wings 16 can thus be fully opened with a pivot angle of significantly less than 90°. In addition, the roof wings 16 can be sealed outside the axis of rotation 90 and independently thereof. The fixed axes 90 are located between 25% and 30% of the container width of the container housing 4 below the container upper edge 102, which is formed in each case by the upper edge of the corresponding side wall 86, wherein the upper lateral roof edge 104 can also be considered as a container upper edge. In addition, the fixed axis 90 is located at a distance from the lateral container wall 86 of less than 5% of the container width.

The fixed axis 90 is an axis of rotation in the form of a fixed axis running parallel to the longitudinal direction of the roof wing 16. The axis of rotation is linked via a lever arm 94 to a lever rod fastened to the axis of rotation 90. The lever rod is attached to a motor unit 96 for actuation of the lever rod. The linking element is implemented from above, in particular via a pulling hydraulics.

The motor unit 96 comprises a thrust bar linkage, which is formed in this embodiment as a hydraulic cylinder. The motor unit 96 is in turn mounted pivotably in a fixed axis 98 and is movably connected via an articulation 100 to the linking element 92. The motor unit 96 is in this case effective by pulling, and its force thus develops in a pulling direction, that is to say with contraction.

To open the roof unit 84, the two motor units 96 are controlled by the control means 62, such that said motor units pivot the linking element 92 about the fixed axis 90. In this case, the two roof wings 16 lift upwardly and to the side, as can be seen in FIG. 17.

Figure 17:
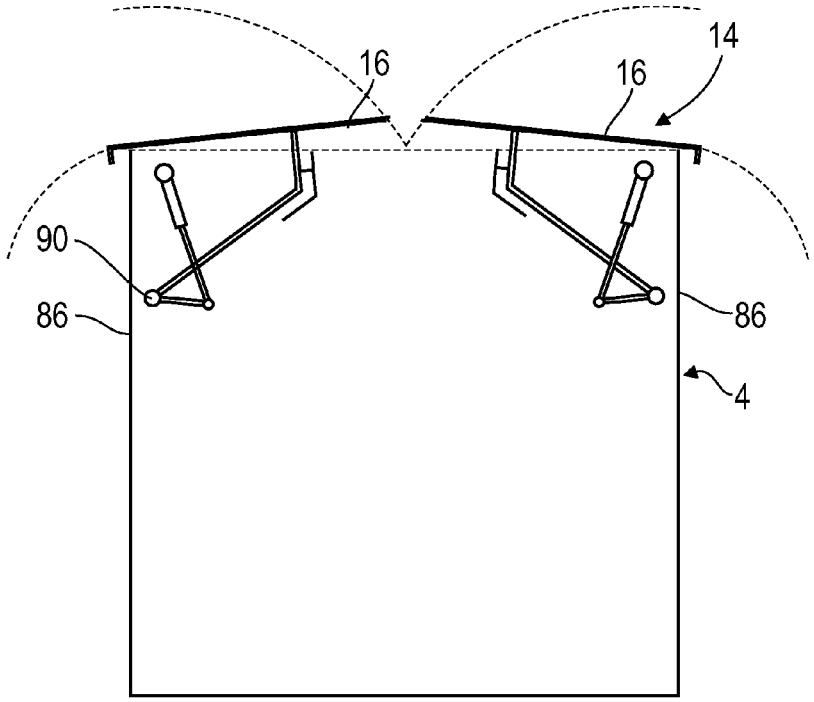
FIG. 17 shows the two roof wings in a slightly open position.

FIG. 17 shows the schematic illustration of the container housing 4 in a cut front view with slightly opened roof unit 84. The movement paths of the inner edge and of the outer side of the roof wings 16 are illustrated in a dashed manner. Due to the rotation of the roof wings 16, in each case about their fixed axis 90, the inner edges lift upwardly, and the outer sides move substantially outwardly in a sideways direction, that is to say become distanced from the side wall 86 in a lateral direction.

Figure 18:
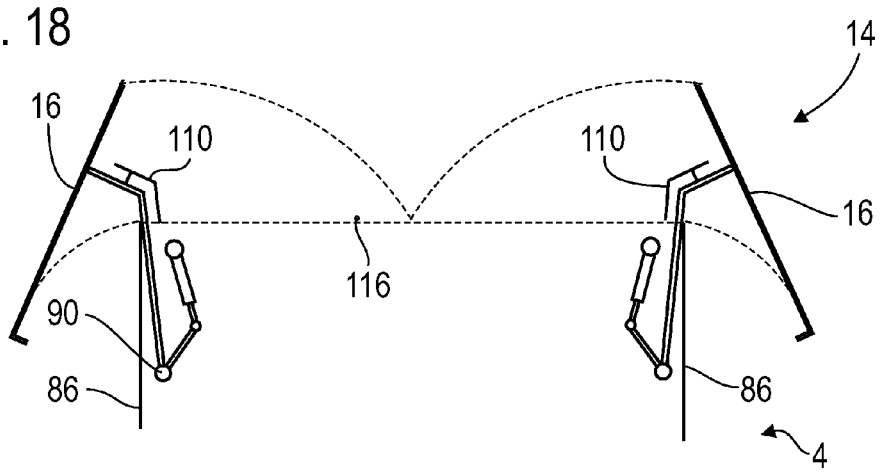
FIG. 18 shows the two roof wings in a fully open position.

FIG. 18 shows the roof unit 84 in the fully open position. The roof wings 16 are located to the side of the side walls 86, that is to say outside the virtual side plane of the container housing 4 spanned by the side walls 86. There is thus much space available to lower objects into the interior of the container housing 4 from above, for example in order to introduce the canisters 20 onto the base 30.

Figure 19:
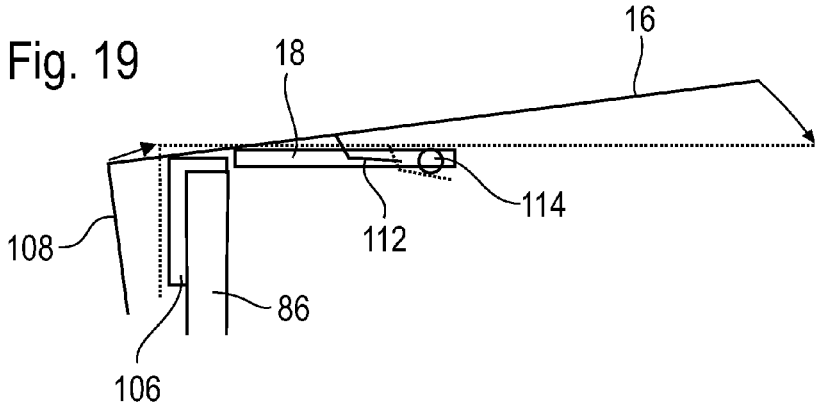
FIG. 19 shows a schematic detailed view of a roof wing shortly before and in the closed position.

As can be seen from FIG. 19, in the upper region of the side wall 86, a seal 106 is arranged, against which the corresponding roof wing 16 bears with its lateral overhang 108, via which the roof wing 16 engages around the side upper edge 102 of the container side wall 86 from above and to the side, when the wing 16 is closed. This overhang 108 pushes from the side from the outside against the seal 106. The closed position of the roof wing 16 is indicated by a dotted line in FIG. 19. It is also possible for the roof wing 16 to rest on the seal 106 from above if it engages around the side upper edge of the container side wall 86 from above, as is illustrated in FIG. 19. During closure, the outer edges of the roof wings 16 move with an angle of displacement of less than 10° to the horizontal towards the lateral container wall 26 and the seal 106.

Due to the overhang 108 overhanging laterally downwardly slightly, the roof wings 16 terminate very tightly against the side wall 86, such that even rain driven by wind cannot infiltrate the interior of the container housing 4 between the roof wings 16 and side wall 86. The opening movement of the roof unit 84 additionally has the advantage that water, sand or muck located on the container roof 14 slips laterally outwardly during the opening process and is guided away from the side wall 86 due to the sideways movement of the outer edge of the roof wings 16. Dirt or water thus flows off laterally from the roof wing 16 and falls down from the container side wall 86 at a distance. An infiltration of dirt, sand or water into the interior of the container is thus avoided.

To protect the seal 106, the roof unit is provided with an inner cover 110, wherein each roof wing 16 has an inner cover 110. The inner cover 110 overlaps the side upper edge 102 of the container housing 4 or the upper edge of the side wall 86 in the open state of the roof unit 84, such that said upper edge is protected against rain or falling dirt over the course of the inner cover 110. The inner cover 110 covers approximately 75% of the seal 106 and is formed as an elongate plate, which can be seen in FIGS. 4, 5, 8, 9 and 10. It is also clear from these figures that each roof wing 16 comprises two linking elements 92 and two motor units 96, such that each roof wing 16 can be lifted in a force-symmetrical manner and can be pivoted outwardly. So as not to collide with the movement mechanism 26, the rear linking element 92 can be placed slightly further forward compared to the position shown in the figures.

In order to keep the motor units 96 force-free in the open state of the roof unit 84, the linking elements 92 in the open state are supported on the side wall 86 of the container housing 4, as can be seen from FIG. 18. The motor units 96 can be connected in a force-free manner, and the roof wings 16, pushed to the side by their weight, remain securely in their open position. In the closed position, the roof wings 16 rest on the container side walls 86 and front and rear supports (not illustrated), such that, even in this position, the motor units 96 can be connected in a force-free manner and the roof unit 84 remains securely closed.

With a method for operating the missile container 2, an operator, once the cover 10 is open, controls the control means 62 via the input means 12 by means of corresponding commands to open the container roof 14 via the input means 12. The control unit 62 controls the motor units 96 of the roof unit 84, such that these bring the roof wings 16 from their closed position or shut position into their open position, as is illustrated in FIG. 18. The missile container 2 is thus brought from the closed state illustrated in FIG. 1 into the open state illustrated in FIG. 8. The movement mechanism 26 is then brought by the corresponding inputs of the operator at the input means 12 from the storage position illustrated in FIG. 8 into the operating position illustrated in FIG. 4. In this case, the movement mechanism 26, in the shown exemplary embodiment specifically the movable members 32, pushes against the roof flaps 18, which are illustrated in FIG. 2, shortly before the operating position is reached. Due to the inclined position of the two movable members 32, the roof flaps 18 are pushed downwardly into an open position against a spring force pushing in the shut position. The roof flaps 18 are closure means which release and close again a corresponding passage for the movement mechanism 26. The movement mechanism 26 moves completely in its operating position and leans against the rear wall of the container housing 4.

Due to corresponding commands in the input means 12, the antenna 22 is folded upwardly. It also pushes against a roof flap 18, which is illustrated in FIG. 1, such that this is pressed on downwardly. Alternatively, the antenna 22 can also be folded out before the movement mechanism 26 moves into its operating position.

By corresponding operating commands on the input means 12, the operator controls the closing of the roof unit 84, such that the two roof wings 16 close again and reach the shut position illustrated in FIG. 3. As the roof wings 16 are closed, the container roof 14 is fully closed. The openings in the container roof 14 released by the roof flaps 18 are then used so that the antenna 22 and the movement mechanism 26 can be guided through the closed container roof 14 without the roof unit 84 having to be open for this purpose. The missile container 2 can thus be kept closed even in its operating position, wherein it is expediently closed in a splashproof manner in this position. Rain or dust flying around therefore does not reach the interior of the container.

If the missile container 2 is to be brought again into its storage state, the roof unit 84 can thus be opened again and the antenna 22 and the movement mechanism 26 brought again into the storage position. In this case, the corresponding elements move out from the passages and the roof flaps 18 move back into their shut position in a spring-driven manner. The passages are thus closed, such that, as the roof wings 16 close, the container roof 14 is again closed. In order to prevent the roof flaps from pressing down in the closed state, form-fit means 112 (see FIG. 19) of the roof wings 16 engage behind holding means 114 of the closed closure means or roof flaps 18. This is illustrated in FIG. 19, from which it can be seen that a form-fit means 112 advances laterally towards the holding means 114 and engages the holding means from behind and below, such that the form-fit means 112 and the holding means 114 form a form fit. The roof flap 18 is now no longer able to press downwards, since the holding means 114 rests on the form-fit means 112.

The roof wings 16 are fastened in their shut position such that a housing-fixed securing means 116 (see FIG. 18), which for example can be formed as a retaining pin, runs into the upper roof wing from the front and thus blocks an opening movement of the roof wing. The upper roof wing 16, in FIG. 18 the left roof wing, overlaps the lower roof wing 16, in FIG. 18 the right roof wing 16, in the inner region in the shut position. Due to this overlap, the lower roof wing 16 is also prevented from moving out from the closure position without an opening of the upper roof wing 16.

Figure 20:
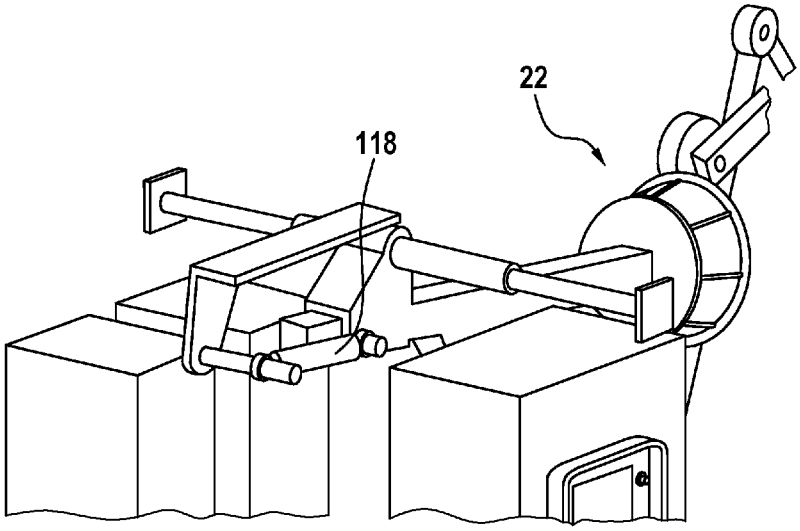
FIG. 20 shows an antenna in a storage position.
Figure 21:
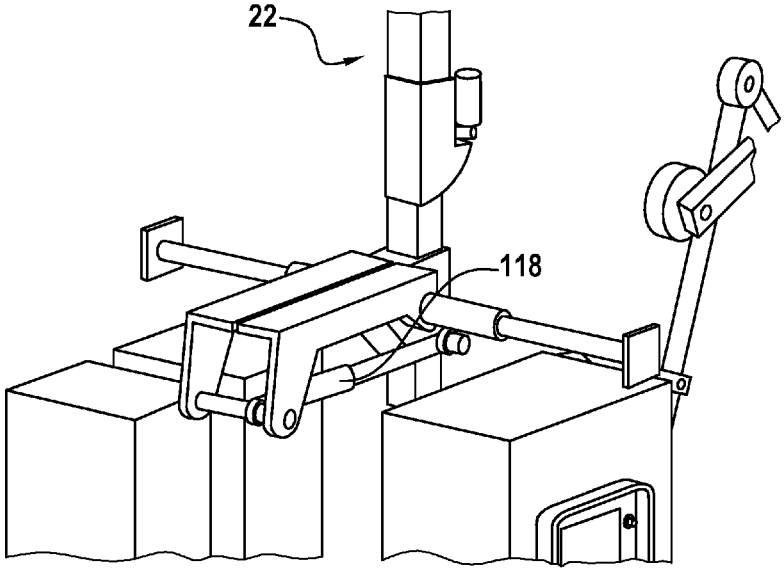
FIG. 21 shows the antenna mechanism from FIG. 20 in an operating position of the antenna.

FIGS. 20 and 21 show the antenna 22 in a storage state of the missile container 2 (FIG. 1 and FIG. 20) and an operating state of the missile container 2 (FIG. 3 and FIG. 21). Due to a movement motor 118 in the form of a hydraulic cylinder, the antenna 22 is folded out from the position located fully in the inner volume of the container into a vertical position, in which the antenna 22 protrudes through the roof opening 24. The movement motor generates, from a linear movement, a rotation of the antenna 22 about an axis of rotation. The antenna 22 is also folded in by the movement motor 118.

The following is a summary list of reference numerals and the corresponding structure used in the above description of the invention:

2 missile container
4 container housing
6 access door
8 interface
10 cover
12 display and input device
14 container roof
16 roof wing
18 roof flap
20 canister
22 antenna
24 roof opening
26 movement mechanism
28 holding unit
30 base
32 movable member
34 movable member
36 rotation point
38 rotation point
40 rotation point
42 rotation point
44 coupler
46 linkage
48 movement motor
50 fixed axis
52 fixed axis
54 pivot axis
56 pivot axis
58 motor unit
60 motor unit
62 control means
64 lever
66 fixed axis
68 fixed axis
70 holding member
72 movement path
74 movement path
76 switch cabinet
78 center of rotation
80 support arm
82 upper side
84 roof unit
86 side wall
88 opening means
90 axis of rotation
92 linking element
94 lever
96 motor unit
98 fixed axis
100 articulation
102 container upper edge
104 roof edge
106 seal
108 overhang
110 inner cover
112 form-fit means
114 holding means
116 securing means
118 movement motor

The invention claimed is:

1. A missile container, comprising:

a container housing;

at least one canister disposed in said container housing and configured for supporting a missile;

a movement mechanism having a kinematic linkage configured for pivoting and moving said at least one canister from a storage position in said container housing into an operation position; and wherein said movement mechanism is configured to pivot said at least one canister from an orientation thereof in the storage position through at least 210° into the operating position.

2. The missile container according to claim 1, wherein said movement mechanism has two housing-fixed fixed axes and said movement mechanism is configured for pivoting said at least one canister from the storage position into the operating position about said two fixed axes.

3. The missile container according to claim 2, wherein said movement mechanism includes a holding unit provided with two pivot axes for holding said at least one canister, and wherein each of said two pivot axes is non-removably affixed via a respective coupling member to a fixed axis.

4. The missile container according to claim 3, wherein said pivot axes and said fixed axes form respective axis pairs, and said axis pairs, in the storage position, are arranged horizontally relative to one another.

5. The missile container according to claim 1, wherein said movement mechanism is configured to lift out said at least one canister fully upwardly from said container housing into the operating position of said at least one canister.

6. The missile container according to claim 1, wherein said container housing is formed with a rear wall disposed between a canister end and an interior of said container housing, in the operating position.

7. The missile container according to claim 1, which comprises a set-down device configured to support said movement mechanism set down in the storage position, and a set-down device configured to support said movement mechanism set down in the operating position.

8. The missile container according to claim 1, wherein said movement mechanism has a leverage with four housing-fixed rotation points.

9. The missile container according to claim 1, wherein said movement mechanism is configured to first move said at least one canister in a translatory motion from the storage position and to subsequently pivot said at least one canister in a pivoting motion into the operating position.

10. A method of operating a missile container having a container housing and at least one canister for supporting a missile, the method comprising:

providing a movement mechanism with a kinematic linkage; and moving the at least one canister with the movement mechanism from a storage position into an operating position by pivoting the at least one canister with the kinematic linkage of the movement mechanism into the operating position over an angular range of 270°.

11. The method according to claim 10, which comprises introducing the canister from above into the container housing and setting the canister down in the housing, subsequently lowering a holding unit of the movement mechanism from above onto the canister, fastening the canister to the holding unit and moving the canister on the holding unit from the storage position into the operating position.

12. The method according to claim 10, which comprises moving the canister in translation by the movement mechanism from the storage position.

13. A method of operating a missile container having a container housing and at least one canister for supporting a missile, the method comprising:

providing a movement mechanism with a kinematic linkage; and moving the at least one canister with the movement mechanism from a storage position into an operating position by pivoting the at least one canister with the kinematic linkage if the movement mechanism and thereby moving the canister with a missile arranged therein into two oppositely aligned positions, detecting a signal if a sensor in the missile in both positions and, from the signals, establishing a state of the sensor.

14. A method of operating a missile container having a container housing and at least one canister for supporting a missile, the method comprising:

providing a movement mechanism with a kinematic linkage; and moving the at least one canister with the movement mechanism by a translatory motion from a storage position and subsequently pivoting the at least one canister over an angular range of 270° into an operating position with the kinematic linkage of the movement mechanism.

* * * * *